United States Patent [19]

Nilsson, deceased

[11] Patent Number: 4,600,049

[45] Date of Patent: Jul. 15, 1986

[54] METHOD AND SYSTEM FOR OPERATING A COOLING PLANT

[75] Inventor: Vilgot Nilsson, deceased, late of Hägersten, Sweden, Mary Nilsson, Goran Nilsson, heirs

[73] Assignee: Alfa-Laval Marine and Power Engineering AB, Tumba, Sweden

[21] Appl. No.: 598,737

[22] Filed: Apr. 10, 1984

[30] Foreign Application Priority Data

Apr. 12, 1983 [SE] Sweden ..... 8302002

[51] Int. Cl.[4] ..... G05D 23/13

[52] U.S. Cl. ..... 165/1; 165/36; 165/39; 165/41

[58] Field of Search ..... 165/35, 36, 39, 40, 165/41, 44, 1

[56] References Cited

U.S. PATENT DOCUMENTS

| | | | |
|---|---|---|---|
| 2,551,697 | 5/1951 | Palmatier | 165/36 X |
| 3,140,824 | 7/1964 | Moore | 165/39 X |
| 4,240,499 | 12/1980 | Kals | 165/39 X |
| 4,260,011 | 4/1981 | Brown | 165/36 X |
| 4,260,103 | 4/1981 | Herring, Jr. | 165/35 X |
| 4,295,519 | 10/1981 | Bellaff | 165/39 X |
| 4,320,798 | 3/1982 | Obernberger | 165/36 |
| 4,347,972 | 9/1982 | Hillerström | 165/39 X |

FOREIGN PATENT DOCUMENTS 1556506 2/1970 Fed. Rep. of Germany ..... 165/36

*Primary Examiner*—Sheldon J. Richter
*Assistant Examiner*—Randolph A. Smith
*Attorney, Agent, or Firm*—Cyrus S. Hapgood

[57] ABSTRACT

On board ships there are cooling systems comprising a heat exchanger (1) operating as a central cooler, through which sea water is pumped by means of different pumps (2–5). Fresh water for cooling the main engine (21) of the ship, and devices (15–18) of various kinds on board the ship, is pumped through the heat exchanger (1) where it is cooled by the sea water. A by-pass conduit (11) extends between the heat exchanger inlet conduit (9) and outlet conduit (10) for fresh water, a three-way valve (12) being arranged to distribute the fresh water flow through the heat exchanger (1) and the by-pass conduit (11), respectively, depending on the momentary cooling demand of the main engine (21) of the ship and/or the devices (15–18). Thereby a predetermined temperature may be maintained in the fresh water circuit. Means are provided for sensing the flow through the heat exchanger (1), or the by-pass conduit (11), and in response thereto increasing or decreasing stepwise the pump capacity for pumping sea water through the heat exchanger (1).

7 Claims, 1 Drawing Figure

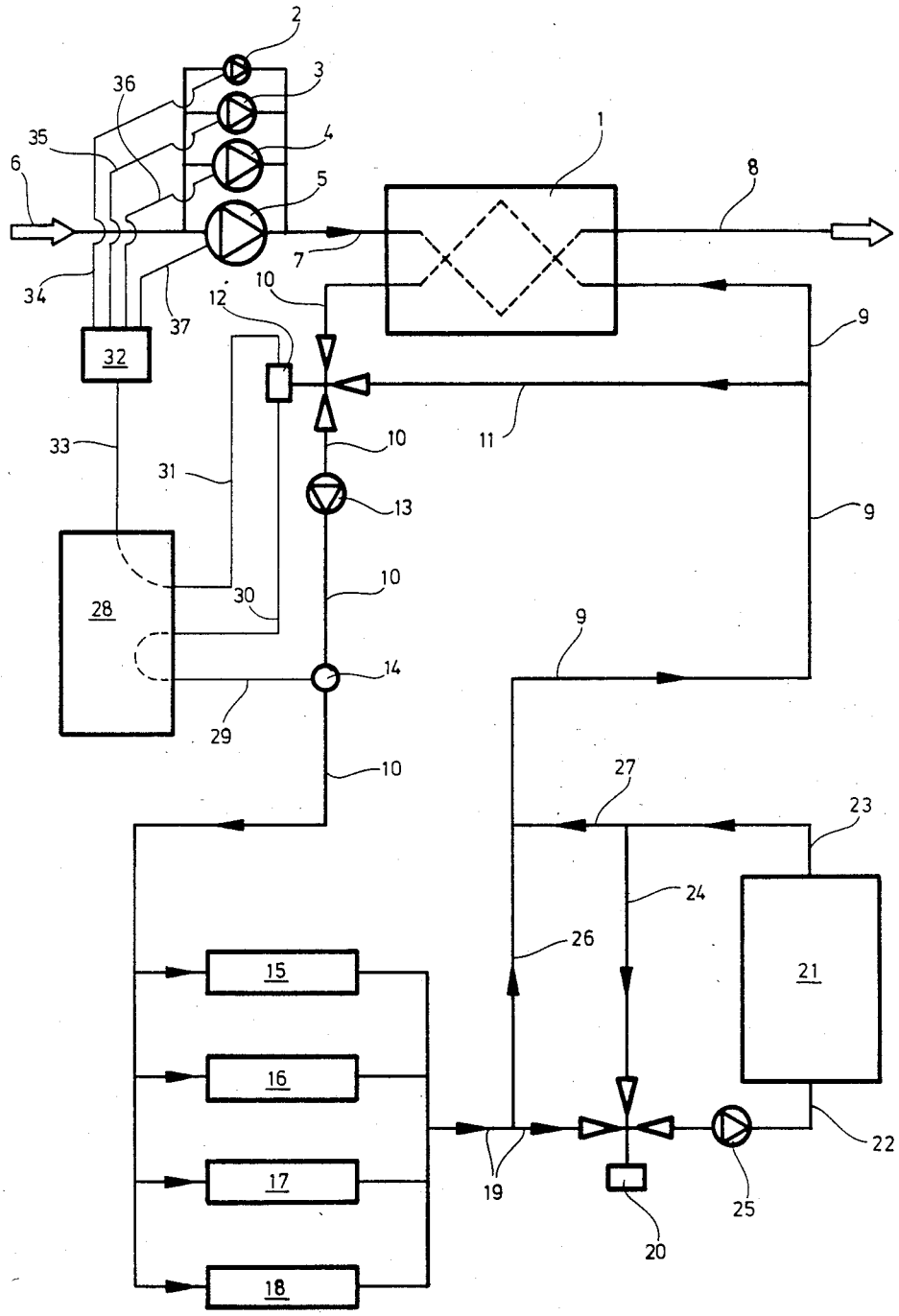
1
2
3
4
5
6
7
8
9
10
11
12
13
14
15
16
17
18
19
20
21
22
23
24
25
26
27
28
29
30
31
32
33
34
35
36
37

METHOD AND SYSTEM FOR OPERATING A COOLING PLANT

The present invention relates to a method and system for controlling the pump capacity required for pumping primary coolant through a heat exchanger arranged as a central cooler in a system of devices with variable cooling demand, the heat exchanger having an inlet conduit coming from said devices and an outlet conduit leading to the devices for secondary coolant, a by-pass conduit extending between said conduits, and a control valve arranged in response to a sensed cooling demand to control the flow of secondary coolant through the by-pass conduit and the heat exchanger, respectively.

Cooling plants of this kind are used on board ships, where sea water is pumped as a coolant to one or more cooperating heat exchangers which are dimensioned to fulfill all the cooling demands existing with the various devices on board. These devices comprise the propelling motor of the ship but also several other motors and a lot of equipment of various kinds.

For safe fulfillment of the cooling demand of the propelling motor of the ship, the present maritime safety rules require that the ship be equipped with at least two different pumps for pumping of primary coolant (sea water) to the central heat exchanger. One of these pumps is a so-called "stand-by" pump. This could mean that a ship has two pumps of the same kind, each of which has sufficient capacity to make the heat exchanger deal with the cooling demand of the whole ship. One of these pumps may for its operation have a so-called two-speed motor so that, if necessary, it can be used with a reduced capacity. Another arrangement is that a ship has three pumps, each of which has a capacity to deal with 50% of the primary coolant flow required for satisfying the whole cooling need of the ship.

The initially mentioned by-pass conduit past the heat exchanger is intended to let through a secondary coolant (water) flow the magnitude of which depends partly on the occasional cooling demand of the devices of the system and partly on the temperature of the primary coolant, i.e. the sea water, prevailing for the moment. The cooling plant on the ship normally is dimensioned to deal with the whole cooling demand of the ship even with a relatively high sea water temperature. This means that the pump capacity for pumping primary cooling water sometimes can be reduced, as when the ship is travelling in relatively cold water and/or when the ship lies at anchor or is propelled with substantially reduced speed.

In practice it is rare, however, on board ships having stepwise controllable pump capacity on the primary cooling water side, that the pump capacity is reduced at decreasing cooling demand. The reason for this is that nobody on board will notice when the cooling demand has decreased exactly to such a degree that said pump capacity may be reduced one step, which in turn depends on the fact that ships have no equipment for indication of such a reduction of the cooling demand. Normally there is a temperature guard in the secondary cooling water circuit connected to an alarm equipment, whereby it is noticed when the temperature in this circuit rises above a certain value, thus indicating a larger cooling demand than can be satisfied by means of the pump capacity on the primary water side used for the moment. However, a temperature guard in this circuit cannot indicate a smaller cooling demand, which might be satisfied with one step less pump capacity on the primary water side, since such a smaller cooling demand would automatically be compensated by means of the previously described control valve. This is performed so that a larger secondary water flow than before is conducted through the by-pass conduit (i.e. a smaller flow is conducted through the heat exchanger), which leads to the situation that the desired temperature is maintained in the secondary cooling water circuit. It has thus been regarded as difficult to automatically control the capacity utilization of the pumps on the primary water side, when the pump capacity is only adjustable stepwise.

As a consequence of the fact that a stepwise adjustable pump capacity for pumping primary cooling water is seldom or never, in practice, adjusted to prevailing cooling demand, much energy is unnecessarily spent for operation of the pumps concerned. Since the motors for operation of these pumps are the very largest consumers of electric energy on board the ship, and since electric energy produced on board the ship is very expensive, it is of great importance that said pumps be used effectively.

A previously known method used for obtaining a more effective utilization of the pumps concerned on board ships resides in the use of equipment for controlling the speed of rotation of the pumps. In one case, the previously described by-pass conduit has been omitted, the pump capacity for pumping primary cooling water being controlled directly in response to a sensed temperature in the secondary cooling water circuit. In another case the capacity of a speed controlled pump has been controlled in response to a sensed temperature of the primary cooling water leaving the heat exchanger.

However, equipment for controlling the rotational speed of pumps is very expensive, and such equipment has rather a low efficiency. Also, the accuracy of the control that can be obtained in connection with control of the rotational speed of pumps is rather poor and, therefore, it is not possible by means of such equipment to obtain an optimum capacity use of the pumps. Thus, to avoid periods with insufficient pump capacity (leading to insufficient cooling) it has been necessary to adjust the control equipment in a way such that the pumps are used on average with somewhat larger capacity than would be really necessary.

An object of the present invention is to provide a simple solution to the problem, in connection with a cooling plant of the initially described kind having stepwise adjustable pump capacity for pumping primary cooling water, of adapting said pump capacity to the prevailing cooling demand.

Another object of the invention is to provide a method and system for enabling an effective use of the pump equipment for pumping primary cooling water in a cooling plant of said kind, meaning that the costs for the cooling, including the costs for acquiring the necessary pump and control equipment as well as the costs for the operation of this equipment, will be lower than could be obtained by means of previously used equipment.

It is a further object of the invention to provide equipment which can easily be mounted in an already existing cooling plant for adjusting said pump capacity to the prevailing cooling demand.

These objects are obtainable by the invention in that a stepwise adjustable pump capacity for pumping primary cooling water through the heat exchanger is controlled in response of the flow of secondary cooling water through one of the by-pass conduit and the heat exchanger, so that the pump capacity is increased when the flow through the by-pass conduit has decreased to a predetermined first rate, and is decreased when the flow through the by-pass conduit has increased to a predetermined higher second rate.

According to a preferred embodiment of the invention, as a measurement of the flow through the by-pass conduit or the heat exchanger, the momentary position is sensed of the valve body of the control valve which is arranged automatically to distribute the flow of secondary cooling water through the by-pass conduit and the heat exchanger, respectively, with regard to a sensed cooling demand in the secondary cooling water circuit.

The invention is described in more detail below with reference to the accompanying drawing, in which the single illustration is a schematic view of an example of a cooling plant intended for use on board a ship.

The cooling plant shown in the drawing comprises a heat exchanger 1, usually a plate heat exchanger, operating as a central cooler. Four pumps 2, 3, 4, 5 are arranged alternatively to be started to pump sea water, taken at 6, through the heat exchanger 1. The pumps 2–5 have different capacities, such as 30, 50, 70 and 100%, respectively, or the maximum requirement of flow of sea water of a certain temperature through the heat exchanger 1. A conduit 7 for the sea water connects the pumps 2–5 with the heat exchanger 1, from which a conduit 8 starts for returning heated sea water to the sea.

The heat exchanger 1 is also arranged for passage therethrough of fresh water to be cooled by the sea water, and it has an inlet conduit 9 and an outlet conduit 10 for such fresh water. A by-pass conduit 11 extends between the inlet conduit 9 and the outlet conduit 10. At the connection between the outlet conduit 10 and the by-pass conduit 11 there is arranged an adjustable three-way valve means 12.

In the outlet conduit 10, downstream from the three-valve 12, there is also arranged a pump 13 and a temperature sensing member 14. The outlet conduit 10 extends from the latter to different devices 15–18 which are to be cooled by means of the water cooled in the heat exchanger 1. These devices may include an air cooler for the main engine of the ship, a lubricant oil cooler, a fresh water distillation apparatus, etc. The number of devices on board requiring cooling is substantially larger than can be seen from the drawing.

From the devices 15–18, a conduit 19 extends to a threeway valve 20 included in a separate cooling circuit for the main engine of the ship, designated 21 in the drawing. In this cooling circuit there are also conduits 22–24 and a pump 25 arranged in the conduit 22.

From the conduit 19 extends a conduit 26 which, together with a conduit 27 arriving from the conduit 23, is connected to the previously mentioned conduit 9 forming the inlet conduit of the heat exchanger 1.

For controlling pumps, valves, etc. of the cooling system, there is a central control unit 28. To this unit there are connected said temperature sensing member 14 (by means of a signal line 29), the three-way valve 12 (by means of signal lines 30 and 31) and equipment 32 for selective starting of the pumps 2–5 (by a signal line 33). Signal lines 34, 35, 36 and 37 extend between the equipment 32 and the respective pumps 2–5.

Also, the three-way valve 20 and a temperature sensing member (not shown) in the cooling circuit 22–25 are connected to the control unit 28.

In the operating of the cooling system, let it be assumed that pump 3 is in operation initially, sea water being pumped through the conduit 7 to the heat exchanger 1 and thence through the conduit 8 again over board. Simultaneously by means of the pump 13, fresh water is pumped through the conduit 10 to the devices 15–18 and further through the conduit 19 to the particular cooling circuit for the main engine 21. From the conduit 19 a first part of the fresh water flows through conduit 26 directly to the conduit 9, whereas the rest of the fresh water flows through the three-way valve 20 and through the conduit 22 to the pump 25. From there the fresh water is pumped through the main engine 21 to the conduit 23, from where part of it is recirculated through the conduit 24 and the rest of it is conducted to the conduit 9 through the conduit 27.

Adjustment of the three-way valve 20 is controlled automatically through the control unit 28 by guidance of the temperature values sensed in the conduits 22 and 23. However, operation of the illustrated system can be understood without reference to the parts 20–25 and 27.

The fresh water coming from the conduits 26 and 27 flows further on through the conduit 9, from where part of it flows through the by-pass conduit 11 directly to the conduit 10, whereas the rest of it flows into the heat exchanger 1 and is cooled by sea water.

Adjustment of the three-way valve 12 is controlled through the control unit 28 in response to the temperature sensed by means of the member 14 in the conduit 10. The three-way valve is adjusted automatically so that the temperature at 14 is constantly maintained at a predetermined value. If occasionally a somewhat larger cooling need arises in the devices 15–18 and/or the main engine 21, the temperature is raised somewhat in the fresh water in the conduit 10. This creates a signal through the signal line 29 to the control unit 28, from where a signal for adjusting the three-way valve 12 is issued to the latter through the signal line 30. As a result, the position of the three-way valve 12 is somewhat changed so that a larger flow of fresh water is caused to flow through the heat exchanger 1, while a correspondingly smaller flow of fresh water is directed through the by-pass conduit 11. Thus, the temperature of the fresh water passing the temperature sensing member 14 will again sink to the previously mentioned predetermined value.

In this way, upon successively rising cooling demand, the flow through the by-pass conduit 11 will be less and less. As a measurement of the flow through the by-pass conduit 11 (and through the heat exchanger 1, respectively) the position of the valve body in the three-way valve 12 is continuously sensed. A signal which is representative of the position of the valve body, and thus of the flow through by-pass conduit 11, goes further on through the signal line 31 to the control unit 28. When this signal indicates that the flow through the by-pass conduit 11 has been reduced to a certain minimum rate, a signal is issued from the control unit 28 to the equipment 32, in which the signal will cause starting of the pump 4 and—after a certain delay—stopping of the pump 3.

The pump 4, which has a larger capacity than the pump 3, will cause an increased flow of sea water through the heat exchanger 1. The flow of fresh water through the heat exchanger 1 will therefore be cooled more effectively than before so that the temperature of the fresh water in the conduit 10 will be lowered. This is sensed by the member 14, leading to a change in the position of the three-way valve 12 so that the flow through by-pass conduit 11 is increased and the flow through the heat exchanger 1 is decreased, until the predetermined temperature is obtained in the conduit 10.

If, after some time, the cooling demand again decreases in the devices 15–18 and/or the main engine 21, the temperature in the conduit 10 will be lowered. This results in changing the position of valve 12 so that a larger flow than before is admitted through the by-pass conduit 11 and a corresponding smaller flow is allowed to pass through the heat exchanger 1. When, as a consequence of a heavily decreased cooling demand, the flow through by-pass conduit 11 has increased to a certain maximum rate, a signal goes from control unit 28 to the equipment 32, in which the signal will cause starting of the pump 3 and—after some delay—stopping of the pump 4.

The pump 3, which has a smaller capacity than the pump 4, will cause a smaller flow of sea water than before through the heat exchanger 1, leading to a less effective cooling of the fresh water passing through the heat exchanger. The resulting increased temperature in the conduit 10 is sensed at 14 and leads to a change in position of the valve 12 so that the flow through by-pass conduit 11 will decrease, until the predetermined temperature is obtained in the conduit 10.

If the cooling demand suddenly increases so heavily that starting of a new pump with one step larger capacity proves insufficient, whereby the flow through by-pass conduit 11 stays at or is reduced below the stated minimum rate, a further new pump is started having one more step larger capacity, etc. Correspondingly, new pumps with less capacity are gradually connected if the cooling demand should suddenly decrease heavily.

In the above-described embodiment of the invention, there are four pumps with different capacities and arranged to be in operation only one at a time. It has been assumed that the pumps are centrifugal pumps. If the pumps are of the positive type, two or more pumps could be in operation simultaneously. In that case, the utilized pump capacity could be varied in several and smaller steps than by means of the pumps according to the above described example. According to another alternative, all the pumps may be of the same size, and more than one pump could be in operation simultaneously even if they are centrifugal pumps. Preferably, one of such pumps of the same size is provided with a so-called two-speed motor, so that it can be operated with two different capacities.

As will be understood from the foregoing, heat exchanger 1 has a primary side for receiving a first flow of primary coolant (sea water) from conduit 7 and a secondary side for receiving a second flow of secondary coolant (fresh water) from conduit 9. The parts 10, 13, 19, 26 and 9 constitute means for circulating secondary coolant from the exchanger's secondary side through the group of devices 15–18 and back to said secondary side. Valve means 12 can be of the type having an element movable to a first position to decrease the by-pass flow through conduit 11 to a low rate and to a second position to increase the by-pass flow to a higher rate. Control unit 28 includes sensing means operable through line 31 for issuing a first signal when the by-pass flow decreases to the low rate (the valve element reaches its first position) and issuing a second signal when the by-pass flow increases to the high rate (the valve element reaches its second position). Equipment 32 constitutes actuating means operable by the sensing means of unit 28 to increase the capacity of pumping means 2–5 in response to said first signal and to decrease the capacity in response to said second signal.

I claim:

1. In the operation of a cooling plant comprising a heat exchanger having a primary side for receiving a first flow of primary coolant and having a secondary side for receiving a second flow of secondary coolant, a group of devices having a variable cooling demand, circulating means including an outlet conduit for delivering coolant from said secondary side to said group and an inlet conduit for returning coolant to said secondary side from said group, a by-pass conduit for flow of coolant from said inlet conduit to said outlet conduit while by-passing said secondary side, a device for sensing changes in said cooling demand, valve means operable under control of the sensing device to increase said second flow while decreasing said by-pass flow, in response to an increase in said demand, and to decrease said second flow while increasing said by-pass flow in response to a decrease in said demand, and pumping means having a stepwise adjustable capacity for pumping primary coolant through said primary side, the method which comprises operating said pumping means at a predetermined capacity while flowing secondary coolant through said circulating means and said by-pass conduit, increasing said capacity in response to said by-pass flow decreasing to a predetermined low rate, and decreasing said capacity in response to said by-pass flow increasing to a predetermined high rate.

2. The method of claim 1, in which said by-pass flow is sensed by sensing the position of a movable valve member of the valve means.

3. In combination with a heat exchanger having a primary side for receiving a first flow of primary coolant and having a secondary side for receiving a second flow of secondary coolant, a group of devices having a variable cooling demand, circulating means including an outlet conduit for delivering coolant from said secondary side to said group and an inlet conduit for returning coolant to said secondary side from said group, a by-pass conduit for flow of coolant from said inlet to said outlet conduit while by-passing said secondary side, and pumping means having a stepwise adjustable capacity for pumping primary coolant through said primary side, a control system comprising a device for sensing changes in said cooling demand, valve means operable under control of the sensing device to increase said second flow while simultaneously decreasing said by-pass flow in response to an increase in said demand, and to decrease said second flow while simultaneously increasing said by-pass flow in response to a decrease in said demand, signaling means for issuing a first signal when said by-pass flow decreases to a predetermined low rate and for issuing a second signal when said by-pass flow increases to a predetermined high rate, and actuating means connected to the pumping means and operable under control of said signaling means to increase said capacity in response to said first signal and to decrease said capacity in response to said second signal.

4. The combination of claim 3, in which said valve means include a valve element movable to a first position to decrease said by-pass flow to said low rate and movable to a second position to increase said by-pass flow to said high rate, said signaling means including means operable to sense the position of said valve element.

5. The combination of claim 3, in which said pumping means include a plurality of pumps having different capacities.

6. The combination of claim 3, in which said sensing device is a device for sensing the temperature of the coolant in said outlet conduit.

7. The combination of claim 6, in which said valve means include a valve element movable to a first position to decrease said by-pass flow to said low rate and movable to a second position to increase said by-pass flow to said high rate, said signaling means including means operable to sense the position of said valve element.

* * * * *